US006448869B1

(12) United States Patent
Kich et al.

(10) Patent No.: US 6,448,869 B1
(45) Date of Patent: Sep. 10, 2002

(54) E-PLANE OFFSET TRANSITIONS IN A SWITCHABLE WAVEGUIDE

(75) Inventors: Rolf Kich, Redondo Beach; Richard L. Bennett; James M. Barker, both of Torrance, all of CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/815,179

(22) Filed: Mar. 21, 2001

(51) Int. Cl.[7] ..... H01P 1/10
(52) U.S. Cl. ..... 333/106; 333/108; 333/258
(58) Field of Search ..... 333/106, 108, 333/258

(56) References Cited

U.S. PATENT DOCUMENTS 4,806,887 A * 2/1989 Au-Yeung ..... 333/106
5,206,610 A * 4/1993 Nelson ..... 333/106

* cited by examiner

*Primary Examiner*—Justin P. Bettendorf
*Assistant Examiner*—Dean Takaoka
(74) *Attorney, Agent, or Firm*—Gates & Cooper LLP

(57) ABSTRACT

An apparatus and method for switching waveguides between a junction waveguide and a bypass waveguide among a plurality of housing ports. The apparatus comprises a housing having a first, second and third housing port and a waveguide rotor, having a first and second rotary position. The waveguide rotor includes a junction waveguide, having a first, second and third junction port, for combining the first, second and third housing ports in the first rotary position and a bypass waveguide, having a first and second bypass port, for connecting the first and second housing ports in the second rotary position. The junction and bypass waveguides are alternately selectable by rotating the waveguide rotor to the first and second rotary positions. The method comprises rotating a waveguide rotor including a junction waveguide having a first, second and third junction port and a bypass waveguide having a first and second bypass port, to a first rotary position in a housing including a first, second and third housing port, whereby the first, second and third junction ports connect the first, second and third housing ports and rotating the waveguide rotor to a second position a bypass waveguide, whereby the first and second bypass ports connect the first and second housing ports.

31 Claims, 5 Drawing Sheets

E-PLANE OFFSET TRANSITIONS IN A SWITCHABLE WAVEGUIDE

BACKGROUND OF THE INVENTION

1. Field of the Invention

The present invention relates to systems and methods for electromagnetic waveguides, and in particular to systems and methods for switchable electromagnetic waveguides in spacecraft.

2. Description of the Related Art

In spacecraft applications, it is often advantageous to combine Traveling Wave Tube Amplifiers (TWTAs) to increase signal broadcast power, while retaining the ability to optionally use the TWTAs singly. Such a need often occurs in Ku Band applications where multiple power amplifiers may often be used. Similarly, it may be advantageous to temporarily divide the output of a single TWTA. Switchable waveguides can be used to perform these functions.

A hybrid waveguide junction, such as a magic tee junction, can be used to combine or divide power. Additionally, a cylindrical waveguide Variable Power combiner/Divider (VPD) can also be used to perform these functions. However, these conventional solutions are more difficult to implement, very expensive and require significant time to manufacture.

Furthermore, in the design of spacecraft, there are certain constant desirable objectives, which tend to vary only in emphasis for any particular application. These include reducing the mass and size of spacecraft components, reducing the time required to build components, improving the manufacturability, and of course, reducing component cost.

There is a need in the art for smaller, lighter, simpler and cheaper devices and methods for switching and combining electromagnetic signals. Particularly, there is a need in the art for a switchable waveguide which duplicates the functionality of a hybrid waveguide and two switch combination or a VPD.

The present invention satisfies these needs.

SUMMARY OF THE INVENTION

To address the requirements described above, the present invention discloses an apparatus and method for switching electromagnetic radiation conducted through waveguides that is lighter, simpler and cheaper than prior art devices.

A waveguide switch comprises a housing having a first, second and third housing port and a waveguide rotor, having a first and second rotary position. The waveguide rotor includes a junction waveguide, having a first, second and third junction port, for combining the first, second and third housing ports in the first rotary position and a bypass waveguide, having a first and second bypass port, for connecting the first and second housing ports in the second rotary position. The junction and bypass waveguides are alternately selectable by rotating the waveguide rotor to the first and second rotary positions.

A method of switching electromagnetic radiation conducted through waveguides comprises rotating a waveguide rotor including a junction waveguide having a first, second and third junction port and a bypass waveguide having a first and second bypass port, to a first rotary position in a housing including a first, second and third housing port, whereby the first, second and third junction ports connect the first, second and third housing ports and rotating the waveguide rotor to a second position a bypass waveguide, whereby the first and second bypass ports connect the first and second housing ports.

In one embodiment of the present invention, a switchable magic tee is employed in a single switch, which performs as two switches and a hybrid in combination. Combining these functions in a single unit significantly reduces the mass, and furthermore, eliminates the need for two switch driver cards. In addition, harness and interconnecting waveguide lengths are reduced. The overall result is a significant reduction in spacecraft mass.

Alternately, the switchable magic tee embodiment of the present invention can duplicate the functions of a cylindrical VPD. The VPD is a very complex device, comprising many elements that require significant expense and time to manufacture. The single switch device of the present invention is significantly less expensive and requires less time to manufacture than the VPD, and can be accomplished without need for special purpose manufacturing tools.

In one embodiment a switchable magic tee places the junction of a magic tee into the rotor of a switch along with two bypass waveguides. This is facilitated, at least in part, by an asymmetric transition step, added to each waveguide rotor port, either the bypass ports or the magic tee junction ports. This allows the rotor ports to be offset with respect to the housing ports.

Furthermore, the magic tee junction ports of the rotor have the mirror image configuration of the bypass ports and are also still electrically matched. This enables the waveguides in the rotor to exist in parallel planes, one above the other. A fourth magic tee junction port is directed out of plane with the rotor waveguides and routed out through a housing port with a choke joint and a large ring bearing.

The foregoing allows a lighter, simpler and cheaper device and method for switching and combining electromagnetic signals than presently known in the art and particularly, duplicates the functionality of a hybrid junction and two switches or a VPD.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1A:
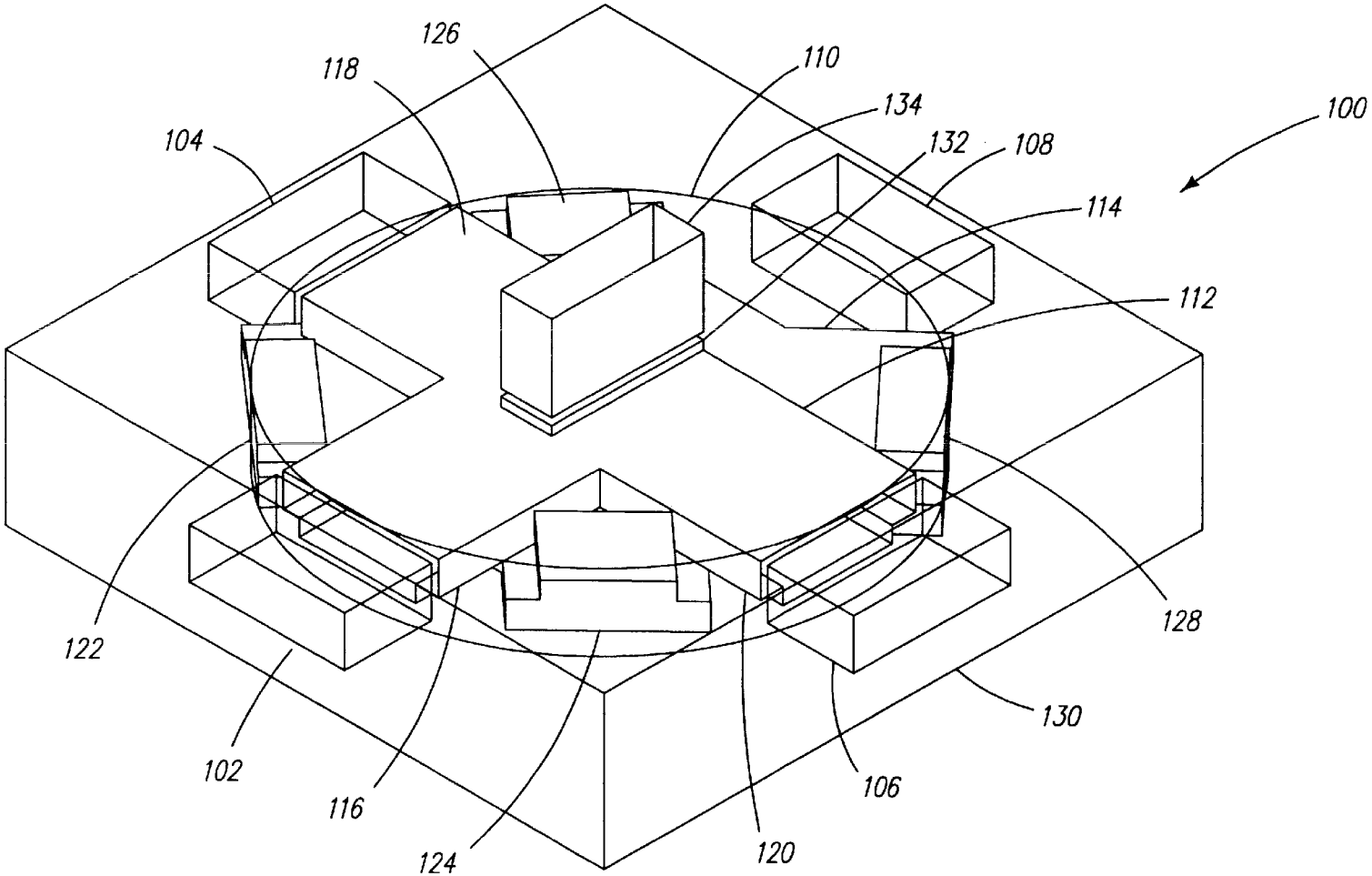
FIGS. 1A–1B illustrate one embodiment of the invention using a magic tee and two bypass waveguides with E-plane offset transitions.

FIG. 1A illustrates an embodiment of the invention using a switchable waveguide with E-plane offset transitions 100. The switchable waveguide 100 places the junction of a half height waveguide magic tee into a flat disc-like switch rotor. The three "in plane" arms of the magic tee junction waveguide 112 intersect the circumference of the waveguide rotor 110 at a first, second and third junction port, 116, 118,

120, the first junction port 116 being positioned 90° from each second and third junction port 118, 120. A fourth, out of plane junction port 132 extends out of the magic tee junction waveguide 112 through the top of the waveguide rotor 110.

Figure 1B:
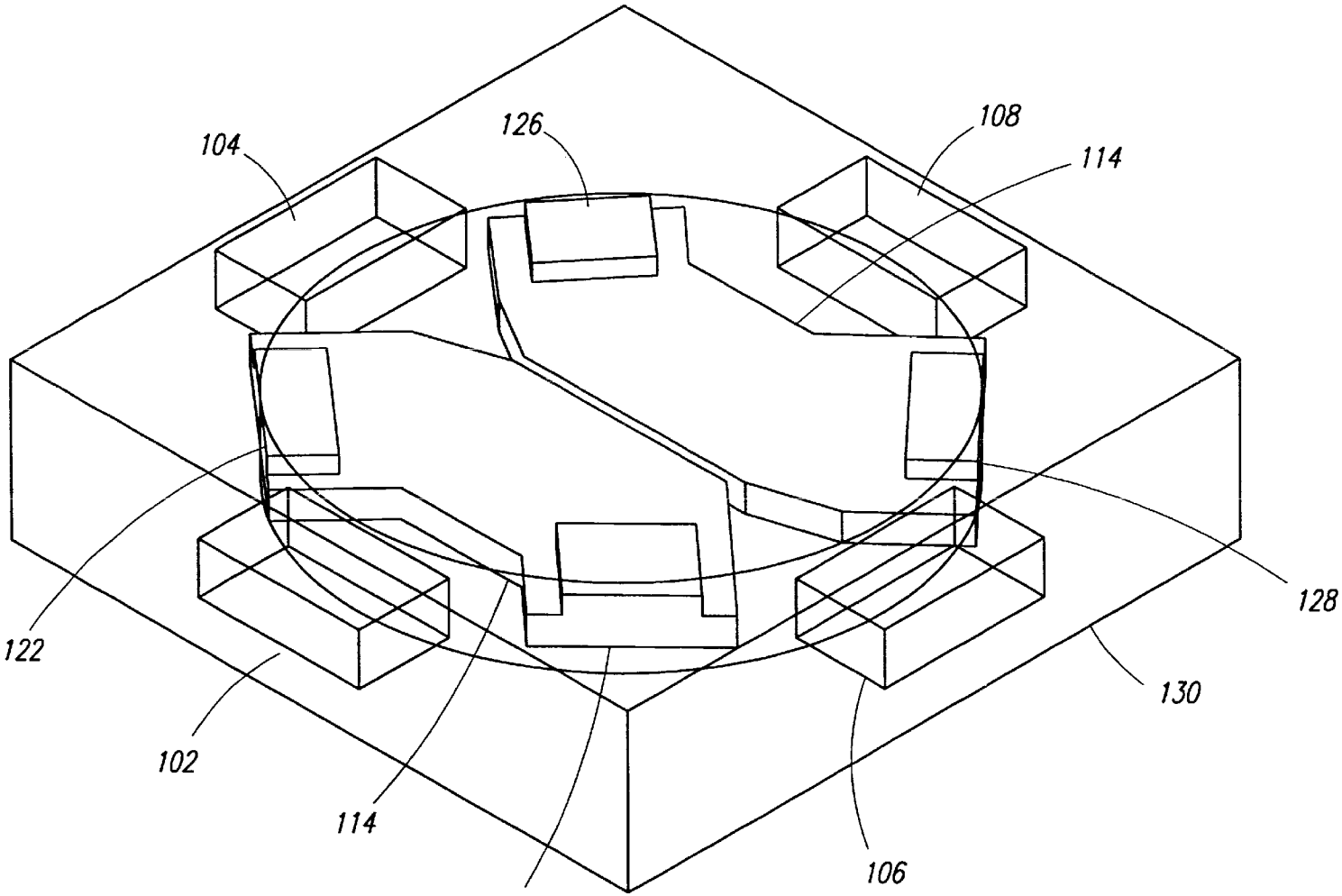

FIG. 1B illustrates the two bypass waveguides 114 in this embodiment, positioned adjacent to one another below the arms of the magic tee junction waveguide 112 in the waveguide rotor 110. The waveguides and magic tee arms sit at two different levels with a minimum wall thickness of approximately 0.020 inches between the waveguides. The ends of the bypass waveguides 114 bend at 45° and intersect the circumference of the waveguide rotor 110 such that a first, second third and fourth bypass port 122, 124, 126, 128 are positioned 90° apart from each other. The housing 130 for the waveguide switch 100 also includes a first, second, third and fourth housing port 102, 104, 106, 108 positioned 90° apart from each other.

An "out of plane" fifth housing port 134 that includes a load element is connected to the junction waveguide along the rotation axis of the waveguide rotor 110. A standard choke joint design is used at the fifth housing port 134 such that the port is enabled with the waveguide rotor in the first position or a position 180° from the first position. A large ring beating is used to dear the fifth housing port 134 with the choke joint.

Figure 2A:
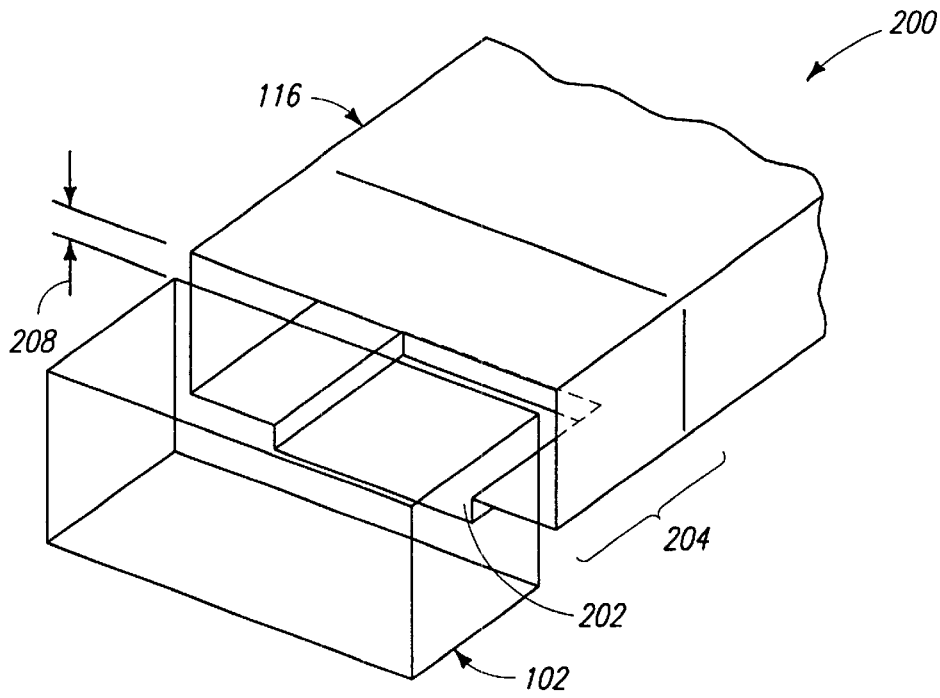
FIGS. 2A–2B illustrate the E-plane offset transitions.
Figure 2B:
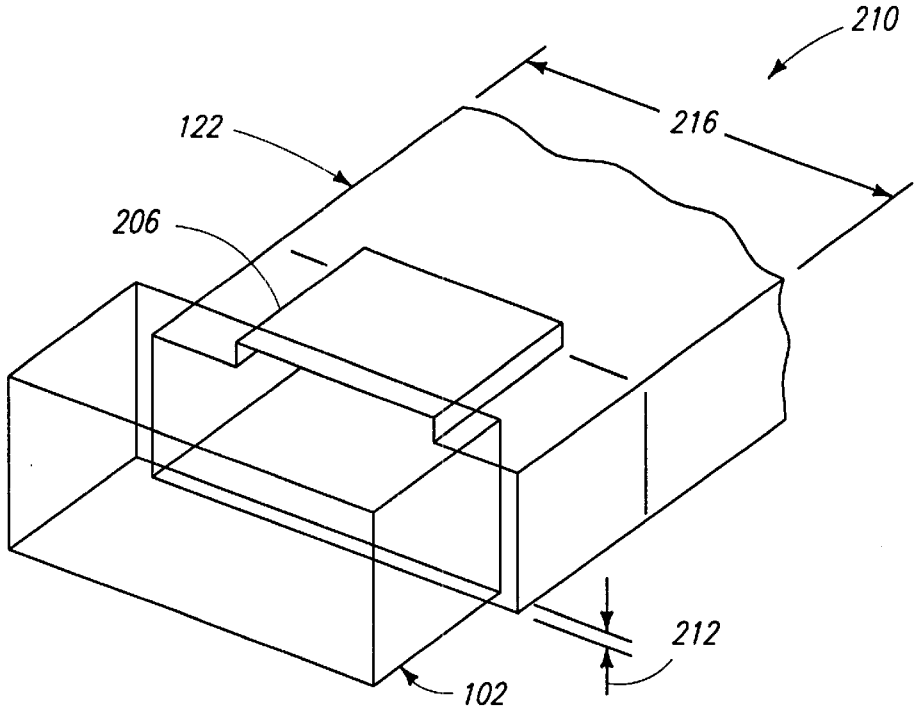

FIGS. 2A–2B illustrate the E-plane offset transitions. The present invention employs an asymmetric set of transitions 200, 210 to connect the junction ports 116, 118, 120 and the bypass ports 122, 124, 126, 128 to the housing ports 102, 104, 106, 108. In the waveguide rotor 110 the junction waveguide 112 and the bypass waveguides 114 are disposed at different levels but alternately connect to intermediate transition waveguide openings in the switch housing 130 at the housing ports 102, 104, 106, 108. The asymmetric transitions 200, 210 are located at the edge of the waveguide rotor 110 circumference.

The transition 200, 210 is a step or notch cut into one broad wall side of the waveguide, partially across the "a" dimension 216, a section of inverted ridge 202, 206. This section mates to the intermediate transition step of the housing ports 102, 104, 106, 108.

When rotated into a connected position, the rotor waveguides, the junction waveguide 112 and the bypass waveguides 114, are offset from the housing ports 102, 104, 106, 108. The junction ports 116, 118, 120 have a high offset 208 and align with the upper portion of the housing ports 102, 104, 106, 108. As shown in FIG. 2A, the partial inverted ridge 206 is on the lower wall. Since they are on a lower plane in the waveguide rotor 110, the bypass ports 122, 124, 126, 128 align with the lower portion of the housing ports 102, 104, 106, 108 and have a low offset 212. As shown in FIG. 2B, the partial inverted ridge 206 is on the upper waveguide wall. The asymmetric transition configuration of the junction waveguide 112 is a mirror image of the bypass waveguide 114 configuration. Standard choke joint designs may be used at the waveguide rotor 110 and housing 130 interfaces.

To keep the design compact, the asymmetric inverted ridge configuration may be employed to clear the opposing rotor waveguide. The two waveguide layers overlap at different positions along the circumference of the waveguide rotor 110. The clearance between the overlapping junction and bypass waveguide arms around the circumference of the waveguide rotor 110 allow for a partial "a" dimension step 204. The "a" dimension walls of the rotor and housing ports across the transition do not line up. However, all rotor ports are still electrically matched, even though they are physically offset from the housing ports.

Figure 3A:
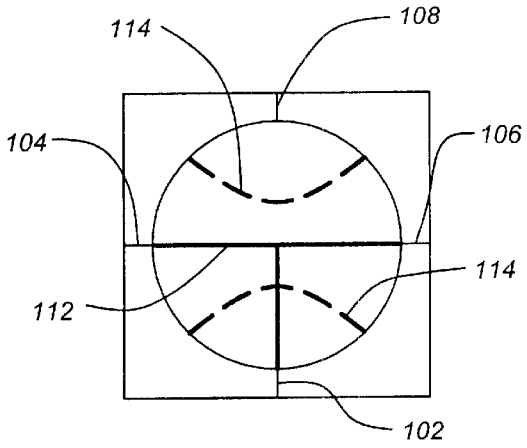
FIGS. 3A–3D are schematic diagrams of an embodiment using a magic tee and two bypass waveguides.
Figure 3B:
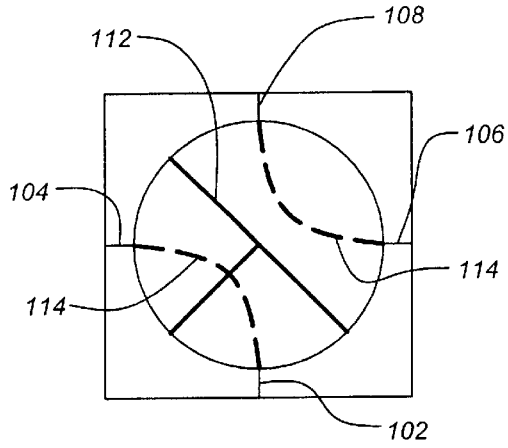

FIGS. 3A–3D are schematic diagrams of an embodiment using a magic tee and two bypass waveguides in various positions. In operation, two inputs separately feed the second and third housing ports 104, 106 in phase. As shown in FIG. 3A, these are combined and output at the first housing port 102 through the junction waveguide 112 with the waveguide rotor 110 in a first rotor position. Alternately, the second housing port 106 can be connected to the first housing port 102 through a bypass waveguide 114 with the waveguide rotor in a second rotor position, as shown in FIG. 3B.

Employing the fourth housing port 108 and a second bypass waveguide 114, not essential to the previously described embodiment, the input at the third housing port 106 may be directed to the fourth housing port 108 simultaneously with the input at the second housing port 104 being directed to the first housing port when the waveguide rotor 110 is in the second rotor position, as shown in FIG. 3B.

Figure 3C:
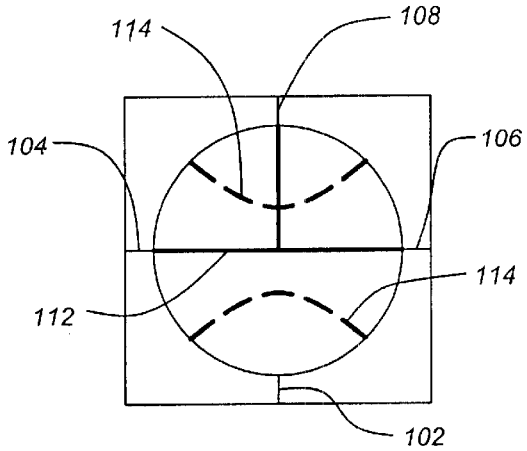

In addition, with the rotor rotated 180° from the first rotor position, the second and third housing ports 104, 106 may be combined at a fourth housing port 108 with the waveguide rotor 110 in a third rotor position, as shown in FIG. 3C.

Figure 3D:
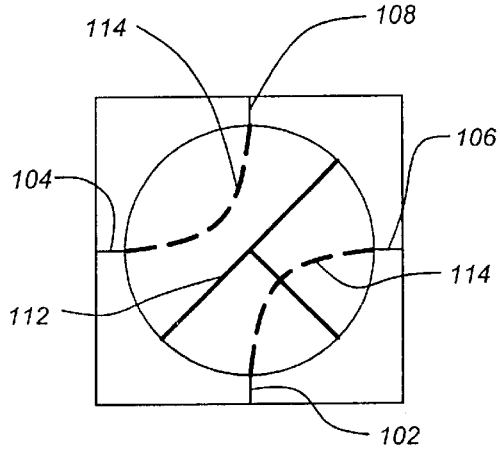

Finally, the second housing port 104 can be connected to the fourth housing port 108 while the third housing port 106 is connected to the first housing port 102 with the waveguide rotor 110 in a fourth rotor position, as shown in FIG. 3D.

The foregoing figures are presented as examples, not an exhaustive list, of the various orientations of the waveguide rotor 110 and attendant functionality of the present invention. Those skilled in the art will recognize many equivalent configurations and additional functions.

Note also that with the present invention a bypass waveguide 114 may be equivalently employed between any two radial adjacent bypass ports 122, 124, 126, 128 irrespective of their relative orientation to the junction waveguide 112.

Figure 4A:
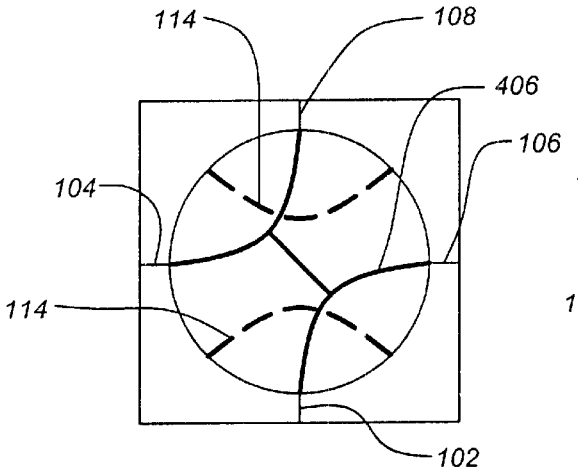
FIGS. 4A–4B are schematic diagrams of an embodiment using a hybrid with two bypass waveguides shown, respectively with the hybrid junction and bypass waveguides activated.
Figure 4B:
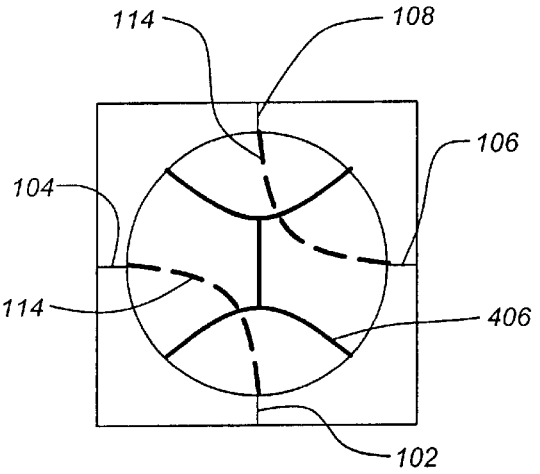

FIGS. 4A–4B are schematic diagrams of another embodiment using a hybrid junction 406 with two bypass waveguides 114 shown with the hybrid junction 406 and bypass waveguides 114 activated. FIG. 4A shows the hybrid activated with the switch in a first position. FIG. 4B shows the bypass waveguides 114 active with the switch in a second position. Two layers of bypass waveguide 114 pairs can be used. One of the layers has the common wall between the pair of bypass waveguides 114 cut away. It is thus converted to a half-height short wall hybrid junction 406, functionally very similar to the magic tee.

Although, as detailed the foregoing embodiments are described as combining power, the device can of course also serve to split signals −3 dB. This is performed with a switchable waveguide slightly larger than a standard waveguide R switch, rather than with two switches and hybrid or the complex cylindrical VPD.

Many modifications may be made to this configuration without departing from the scope of the present invention. For example, other waveguide heights may also be employed, different numbers of ports may be disposed at various locations and in different combinations around the circumference of the waveguide rotor 110 and housing 130. Bends can also be incorporated, either in the waveguide rotor 110 or housing 130, to have axial ports, positioned at upper and/or lower surfaces of the waveguide rotor 110 and housing 130 rather than only radial ports, positioned around the rotor circumference. Those skilled in the art will recognize that any combination of the above components, or any number of different components and other devices, may be used with the present invention.

CONCLUSION

This concludes the description of the preferred embodiments of the present invention. In summary, the present invention describes an apparatus and method for switching between a junction waveguide and a bypass waveguide among a plurality of housing ports.

The waveguide switch 100 comprises a housing 130 having a first, second and third housing port 102, 104, 106, 108 and a waveguide rotor 110, having a first and second rotary position. The waveguide rotor 110 includes a junction waveguide 112, having a first, second and third junction port 116, 118, 120, for combining the first, second and third housing ports 102, 104, 106 in the first rotary position and a bypass waveguide 114, having a first and second bypass port 122, 124, for connecting the first and second housing ports 102, 104 in the second rotary position. The junction and bypass waveguides 112, 114 are alternately selectable by rotating the waveguide rotor to the first and second rotary positions.

The method comprises rotating a waveguide rotor 110 including a junction waveguide 112 having a first, second and third junction port 116, 118, 120 and a bypass waveguide 114 having a first and second bypass port 122, 124, to a first rotary position in a housing 130 including a first, second and third housing port 102, 104, 106, whereby the first, second and third junction ports 116, 118, 120 connect the first, second and third housing ports 102, 104, 106 and rotating the waveguide rotor 110 to a second rotary position, whereby the first and second bypass ports 122, 124 connect the first and second housing ports 102, 104.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A waveguide switch comprising:

a housing having a first, second and third housing port; and a waveguide rotor, having a first and second rotary position, including:

a junction waveguide, having a first, second and third junction port, for combining the first, second and third housing ports in the first rotary position;

a bypass waveguide, having a first and second bypass port, for connecting the first and second housing ports in the second rotary position;

wherein the junction and bypass waveguides are alternately selectable by rotating the waveguide rotor to the first and second rotary positions; and wherein the first and second bypass ports have an asymmetric transition step and a mirror image configuration of the first, second and third junction ports.

2. The waveguide switch of claim 1, wherein the first, second and third housing ports, the first, second and third junction ports, and the first and second bypass ports are axial to the waveguide rotor.

3. The waveguide switch of claim 1, wherein the first, second and third housing ports, the first, second and third junction ports, and the first and second bypass ports are radial to the waveguide rotor.

4. The waveguide switch of claim 1, wherein the ports of the rotor are substantially electrically matched with the housing ports.

5. The waveguide switch of claim 1, wherein, the waveguide rotor further includes a third rotary position alternately selectable with the first and second rotary positions and the housing further includes a fourth housing port;

wherein the second, third and fourth housing ports are connected via the junction waveguide in the second rotary position.

6. The waveguide switch of claim 5, wherein the waveguide rotor further include a second bypass waveguide having a third and fourth bypass port and the waveguide rotor further includes a fourth rotary position;

wherein the third and fourth housing ports are connected via the second bypass waveguide in the second rotary position;

wherein the first and third housing ports are connected via the first bypass waveguide and the second and fourth housing ports are connected via the second bypass waveguide in the fourth rotary position.

7. The waveguide switch of claim 6, wherein the first, second, third and fourth housing ports are disposed around a circumference of the waveguide rotor at approximately 90° intervals.

8. The waveguide switch of claim 6, wherein the junction waveguide is a half-height short wall hybrid junction.

9. The waveguide switch of claim 6, wherein the junction waveguide is a magic tee.

10. The waveguide switch of claim 9, wherein the housing further includes a fifth housing port, having a load and connected to the junction waveguide along a rotation axis of the waveguide rotor.

11. The waveguide switch of claim 10, wherein the fifth housing port is connected to the junction waveguide via a choke joint and ring bearing.

12. A waveguide switch comprising:

a waveguide rotor having a first and second rotary position, including:

a first rotor port, having an asymmetric transition step;

a second rotor port, having an asymmetric transition step and a mirror image configuration of the first rotor port; and a housing port;

wherein the first and second rotor ports are electrically matched with the housing port and wherein, the first rotor port is engaged with the housing port in the first rotary position and the second rotor port is engaged with the housing port in the second rotary position.

13. The waveguide switch of claim 12, wherein the housing port is axial to the waveguide rotor.

14. The waveguide switch of claim 12, wherein the first rotor port has a high offset with the housing port and the second rotor port has a low offset with the housing port.

15. The waveguide switch of claim 12, wherein the housing port is radial to the waveguide rotor.

16. The waveguide switch of claim 12, wherein the waveguide rotor further includes a junction waveguide for connecting at least one of the first and second rotor ports to the housing port.

17. The waveguide switch of claim 16, wherein the junction waveguide is a half-height short wall hybrid junction.

18. The waveguide switch of claim 16, wherein the junction waveguide is a magic tee.

19. The waveguide switch of claim 16, wherein the housing further includes a second housing port, having a load and connected to the junction waveguide along a rotation axis of the waveguide rotor.

20. The waveguide switch of claim 19, wherein the second housing port is connected to the junction waveguide via a choke joint and ring bearing.

21. A method of switching waveguides, comprising:

rotating a waveguide rotor, including a junction waveguide having a first, second and third junction port and a bypass waveguide having a first and second bypass port, to a first rotary position in a housing including a first, second and third housing port, whereby the first, second and third junction ports connect the first, second and third housing ports; and rotating the waveguide rotor to a second position, whereby the first and second bypass ports connect the first and second housing ports;

wherein the first and second bypass ports have an asymmetric transition step and a mirror image configuration of the first, second and third junction ports.

22. The method of claim 21, wherein the first, second and third housing ports, the first, second and third junction ports, and the first and second bypass ports are axial to the waveguide rotor.

23. The method of claim 21, wherein the first, second and third housing ports, the first, second and third junction ports, and the first and second bypass ports are radial to the waveguide rotor.

24. The method of claim 21, wherein the ports of the rotor are electrically matched with the housing ports.

25. The method of claim 21, wherein the waveguide rotor has a third rotary position alternately selectable with the first and second rotary positions for connecting first and third housing ports via the bypass waveguide.

26. The method of claim 25, wherein, the housing further includes a fourth housing port and the waveguide rotor further includes a second bypass waveguide having a third and fourth bypass port for connecting the third and fourth housing ports in the second rotary position and the second and fourth housing ports in the third rotary position.

27. The method of claim 26, wherein the first, second, third and fourth housing ports are disposed around a circumference of the waveguide rotor at 90° intervals.

28. The method of claim 26, wherein the junction waveguide is a half height short wall hybrid.

29. The method of claim 26, wherein the junction waveguide is a magic tee.

30. The method of claim 29, wherein the housing further includes a fifth housing port, having a load and connected to the junction waveguide along a rotation axis of the waveguide rotor.

31. The method of claim 30, wherein the fifth housing port is connected to the junction waveguide via a choke joint and ring bearing.

* * * * *